US011187120B2

(12) United States Patent
Taguchi

(10) Patent No.: US 11,187,120 B2
(45) Date of Patent: Nov. 30, 2021

(54) OIL PAN FOR INTERNAL COMBUSTION ENGINE

(71) Applicant: NISSAN MOTOR CO., LTD., Yokohama (JP)

(72) Inventor: Arata Taguchi, Yokohama (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 216 days.

(21) Appl. No.: 14/433,388

(22) PCT Filed: Oct. 15, 2013

(86) PCT No.: PCT/JP2013/077906
§ 371 (c)(1),
(2) Date: Apr. 3, 2015

(87) PCT Pub. No.: WO2014/073332
PCT Pub. Date: May 15, 2014

(65) Prior Publication Data

US 2015/0252696 A1 Sep. 10, 2015

(30) Foreign Application Priority Data

Nov. 6, 2012 (JP) ..... JP2012-244048

(51) Int. Cl.
*F01M 11/00* (2006.01)
*F01M 11/06* (2006.01)

(52) U.S. Cl.
CPC ..... *F01M 11/0004* (2013.01); *F01M 11/064* (2013.01); *F01M 2011/002* (2013.01);
(Continued)

(58) Field of Classification Search
CPC ..... F02B 77/00; F16N 31/002; F16N 31/004; F02M 11/00; F02M 11/0004;
(Continued)

(56) References Cited

U.S. PATENT DOCUMENTS 1,365,438 A * 1/1921 Adamson ..... F01M 11/0004 165/179
6,550,440 B1 * 4/2003 Vrsek ..... F01M 11/0004 123/184.61

(Continued)

FOREIGN PATENT DOCUMENTS

EP 1985817 A1 10/2008
FR 2849467 A1 7/2004

(Continued)

OTHER PUBLICATIONS

Longitudinal _ Definition of Longitudinal by Merriam-Webster.pdf (Year: 2020).*
Sole _ Definition of Sole by Merriam-Webster.pdf (Year: 2020).*

*Primary Examiner* — Michael A Kessler
(74) *Attorney, Agent, or Firm* — Faegre Drinker Biddle & Reath LLP

(57) ABSTRACT

[Summary] Oil pan (10) for containing engine oil is configured so as to be divided into metallic upper oil pan (13) and synthetic resin lower oil pan (14). Upper oil pan (13) and lower oil pan (14) are respectively provided with beam (25) and rib (24), which extend in the front-rear direction of the vehicle. Beam (25) and rib (24) are caused to face each other with gap (26) provided therebetween. When external force which can deform lower oil pan (14) in the front-rear direction of the vehicle acts on lower oil pan (14) due to the interference thereof with curbstones or the like, beam (25) and rib (24) come into contact with each other and prevent lower oil pan (14) from deforming in the front-rear direction of the vehicle.

7 Claims, 11 Drawing Sheets

(52) U.S. Cl.
CPC ..... *F01M 2011/0041* (2013.01); *F01M 2011/0087* (2013.01)

(58) Field of Classification Search
CPC ..... F02M 11/064; F01M 2011/002; F01M 2011/0004; F01M 2011/0008; F01M 2011/0037; F01M 2011/0041; F01M 2011/0091; F01M 2011/0087
USPC ..... 123/195 C, 196 R, 198 E; 184/106, 69.1; 220/573
See application file for complete search history.

(56) References Cited

U.S. PATENT DOCUMENTS

| | | | | |
|---|---|---|---|---|
| 7,748,500 | B2 * | 7/2010 | Nagano ..... | F01M 11/0004 184/106 |
| 2008/0264727 | A1 | 10/2008 | Nagano et al. | |
| 2010/0162988 | A1 * | 7/2010 | Enokida ..... | F01M 11/0004 123/195 C |

FOREIGN PATENT DOCUMENTS

| | | | | | |
|---|---|---|---|---|---|
| JP | H02-298654 | A | | 12/1990 | |
| JP | H04-132445 | U | | 12/1992 | |
| JP | H05-50012 | U | | 7/1993 | |
| JP | H0575456 | | * | 10/1993 | ..... F01M 11/00 |
| JP | 09195852 | A | * | 7/1997 | |
| JP | 2008-274793 | A | | 11/2008 | |
| JP | 2010-174653 | A | | 8/2010 | |
| JP | 2010-174654 | A | | 8/2010 | |
| RU | 2115813 | C1 | | 7/1998 | |
| RU | 9264 | U1 | | 2/1999 | |

* cited by examiner

OIL PAN FOR INTERNAL COMBUSTION ENGINE

TECHNICAL FIELD

The present invention relates to an oil pan for use in an internal combustion engine, comprising an upper oil pan and a lower oil pan, and particularly to a technique of preventing the lower oil pan from deforming in the front-rear direction of the vehicle.

BACKGROUND OF THE INVENTION

As disclosed in Patent Publication 1, an oil pan for an internal combustion engine is configured so as to be divided into: an upper oil pan fixed to a lower section of a cylinder block to mainly constitute a shallow bottom part; and a lower oil pan fixed on a lower side of the upper oil pan to mainly constitute a deep bottom part.

REFERENCES ABOUT PRIOR ART

Patent Documents

Patent Document 1: Japanese Patent Application Publication No. 2010-174653

SUMMARY OF THE INVENTION

Problems to be Solved by the Invention

The lower oil pan that locates at the bottommost of the internal combustion engine bears a possibility of causing interference with curbstones, road surfaces and the like, and therefore subject to deformation or breakage when receiving external force due to the interference from the front-rear direction of the vehicle. Particularly in the case of adopting a lower oil pan formed of synthetic resin for the purpose of weight reduction or the like as discussed in the above-mentioned Patent Publication 1, the lower oil pan is insufficient in ductility so that deformation or breakage thereof is difficult to prevent as compared with the case of adopting a metallic lower oil pan formed of a steel sheet or the like.

In view of the above circumstances, an object of the present invention is to provide a novel oil pan for an internal combustion engine which can effectively be prevented from deformation of the lower oil pan in the event that external force in the front-rear direction of the vehicle due to the interference with curbstones, road surfaces or the like is applied to the lower oil pan.

Means for Solving the Problems

An oil pan for storing an engine oil is configured to have: an upper oil pan fixed to an engine body such as a cylinder block; and a lower oil pan fixed on the lower side of the upper oil pan. The oil pan further includes a strength member fixed to the upper oil pan or the engine body. Additionally, this oil pan is so arranged as to bring the lower oil pan into contact with the strength member when receiving external force that can deform the lower oil pan in the front-rear direction of the vehicle, thereby suppressing deformation of the lower oil pan in the front-rear direction of the vehicle.

Effects of the Invention

According to the present invention, the lower oil pan is arranged to come into contact with the strength member when receiving external force from the front-rear direction of the vehicle due to interference with curbstones, road surfaces and the like, with which the lower oil pan is kept from deformation. Hence it becomes possible to effectively suppress deformation of the lower oil pan while attaining weight reduction by forming the lower oil pan from a synthetic resin material.

BRIEF DESCRIPTION OF THE DRAWINGS

FIG. 7 An explanatory view showing an event where the oil pan interferes with curbstones or the like.

MODE(S) FOR CARRYING OUT THE INVENTION

Referring now to the accompanying drawings, preferable embodiments of the present invention will be explained.

Referring FIGS. 1 to 7, there will firstly be explained a first embodiment of the present invention, where oil pan 10 relating to a first embodiment of the present invention is applied to an internal combustion engine of a vertically installable type.

Figure 7:
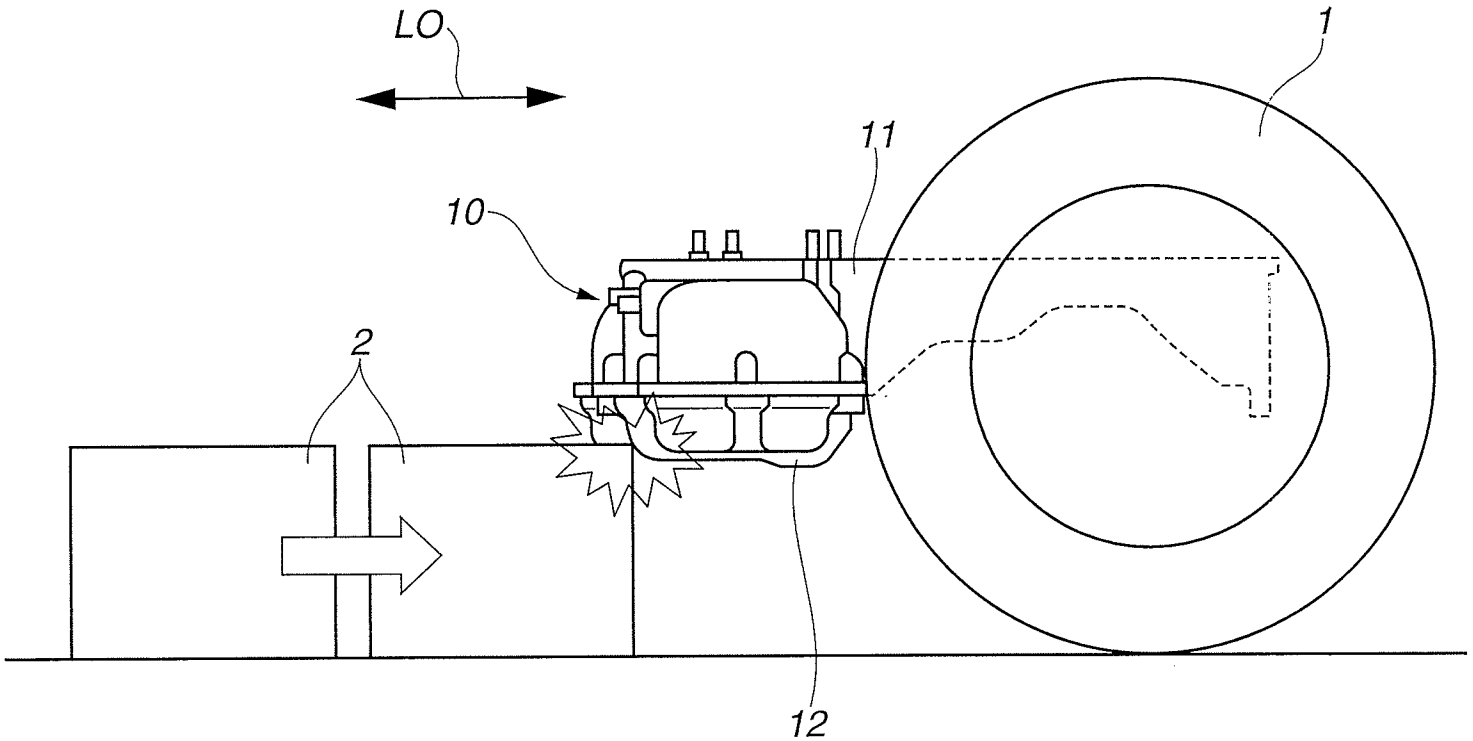

As shown in FIG. 7, oil pan 10 is disposed under a longitudinally installed type internal combustion engine (installed in an engine compartment located at a frontward position of a vehicle, in such a posture that the direction of the crankshaft is parallel to the front-rear direction of the vehicle) and provided to have a shape of a box opened at an upper portion. Oil pan 10 is provided to include shallow bottom part 11, and deep bottom part 12 larger than shallow bottom part 11 in dimension of the vertical direction (or in depth). Deep bottom part 12 is disposed at the frontward position of the vehicle. Incidentally, a member illustrated in FIG. 7 by reference numeral 1 is a front wheel of the vehicle.

As shown in FIGS. 1 to 4 and 6, oil pan 10 is so configured as to be divided into: metallic upper oil pan 13 formed of a metallic material such as aluminum alloys and the like; and synthetic resin lower oil pan 14 formed of a synthetic resin material.

Upper oil pan 13 is to be fixed to a lower section of a cylinder block (not shown, behaving as a part of a main body of an internal combustion engine) with bolts (not shown), and provided to include at its upper edge upper flange portion 15 having a certain thickness. Upper flange portion 15 is formed with bolt holes 16 into which the above-mentioned bolts are inserted. Upper oil pan 13 is provided extending almost over the length of the internal combustion engine in the vehicle front-rear direction "LO" and constitutes shallow bottom part 11 by its peripheral wall portion 17 and bottom wall portion 18.

Figure 6:
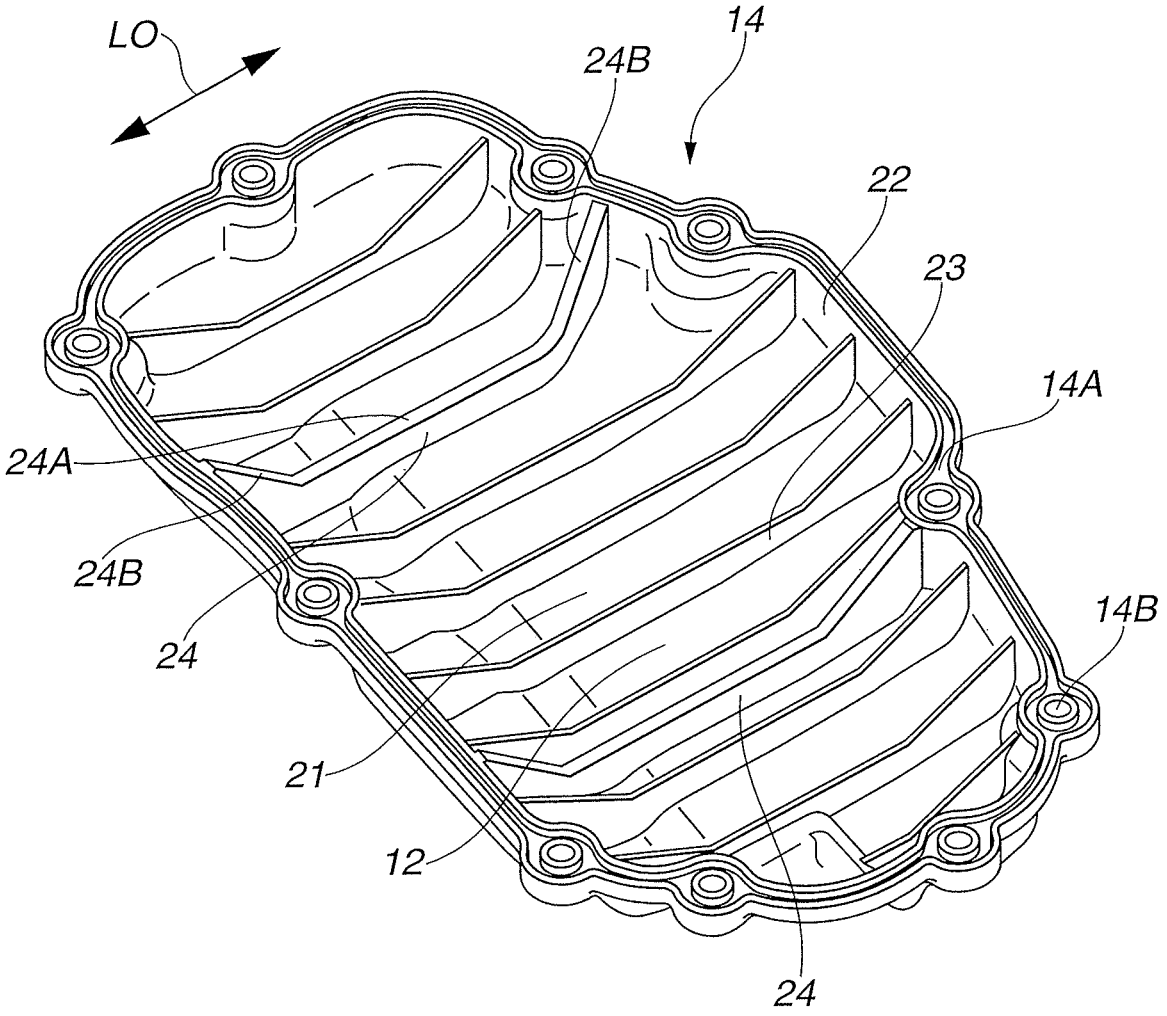
FIG. 6 A perspective view of the first embodiment of the oil pan, showing a lower oil pan alone.

FIG. 6 illustrates lower oil pan 14 independently. As shown in FIG. 6, lower oil pan 14 is provided to have a shape of an upwardly opened saucer which is to be liquid-tightly attached or fixed to lower flange portion 20 (having a certain thickness and formed at a peripheral edge portion defining lower side opening 19) through a sealing material (not shown) in such a manner as to fill lower side opening 19 that upper oil pan 13 defines by its peripheral edge portion on the front side of bottom wall portion 18. Lower oil pan 14 is formed, at its opened upper edge section, to have a seal groove 14A into which the above-mentioned sealing material is fitted, and a plurality of bolt holes 14B into which fixing bolts are to be inserted. Lower oil pan 14 constitutes deep bottom part 12 by its peripheral wall section 21 and bottom wall section 22.

Lower oil pan 14 is formed integral with a plurality of reinforcing ribs 23 that extend in the interior of lower oil pan 14 along the front-rear direction of the vehicle (along LO) in a posture mounted on a vehicle. Each of reinforcing ribs 23 is shaped like a thin plate protruding from bottom wall section 22 of lower oil pan 14, and provided to extend across lower oil pan 14 in the front-rear direction of the vehicle (along LO) from a front-side peripheral wall section to a rear-side peripheral wall section. Each of reinforcing ribs 23 is, at both ends, integrally connected to peripheral wall section 21 of lower oil pan 14.

Reinforcing ribs 23 are shaped such that their top edges are cut away downwardly, and more specifically, provided to include central flat region 23A the top edge (or top surface) of which is along a substantially horizontal direction and a pair of inclined regions 23B the top edges of which extend obliquely upward from both ends of flat region 23A toward peripheral wall section 21 of lower oil pan 14. Thus reinforcing ribs 23 are arranged such that flat regions 23A are located at the lowermost position among the top edges of the reinforcing ribs 23 and flat regions 23A are formed far wider than inclined regions 23B, in order not to inhibit an engine oil from flowing in the front-rear direction "LO" of the vehicle.

Similarly to reinforcing ribs 23, lower oil pan 14 also includes two deformation-preventing ribs 24 integrally formed therewith and extending in the interior of lower oil pan 14 along the front-rear direction of the vehicle (or along the direction "LO") in a posture mounted on a vehicle. Each of deformation-preventing ribs 24 is shaped like a thin plate protruding from bottom wall section 22 of lower oil pan 14, and provided to extend across lower oil pan 14 in the front-rear direction of the vehicle (or along the direction "LO") from the front-side peripheral wall section to the rear-side peripheral wall section, and is integrally connected at both ends to peripheral wall section 21 of lower oil pan 14, likewise reinforcing ribs 23.

Deformation-preventing ribs 24 are shaped such that their top edges (or top surfaces) are cut away downwardly in the same manner as in reinforcing ribs 23, and more specifically, provided to include flat region 24A the top edge of which is along a substantially horizontal direction and a pair of inclined regions 24B the top edges of which extend obliquely upward from both ends of flat region 24A toward peripheral wall section 21 of lower oil pan 14. Thus deformation-preventing ribs 24 are provided such that flat regions 24A are located at the lowermost position and flat regions 24A are formed far wider than inclined regions 24B, in order not to inhibit an engine oil from flowing in the front-rear direction "LO" of the vehicle.

Figure 4:
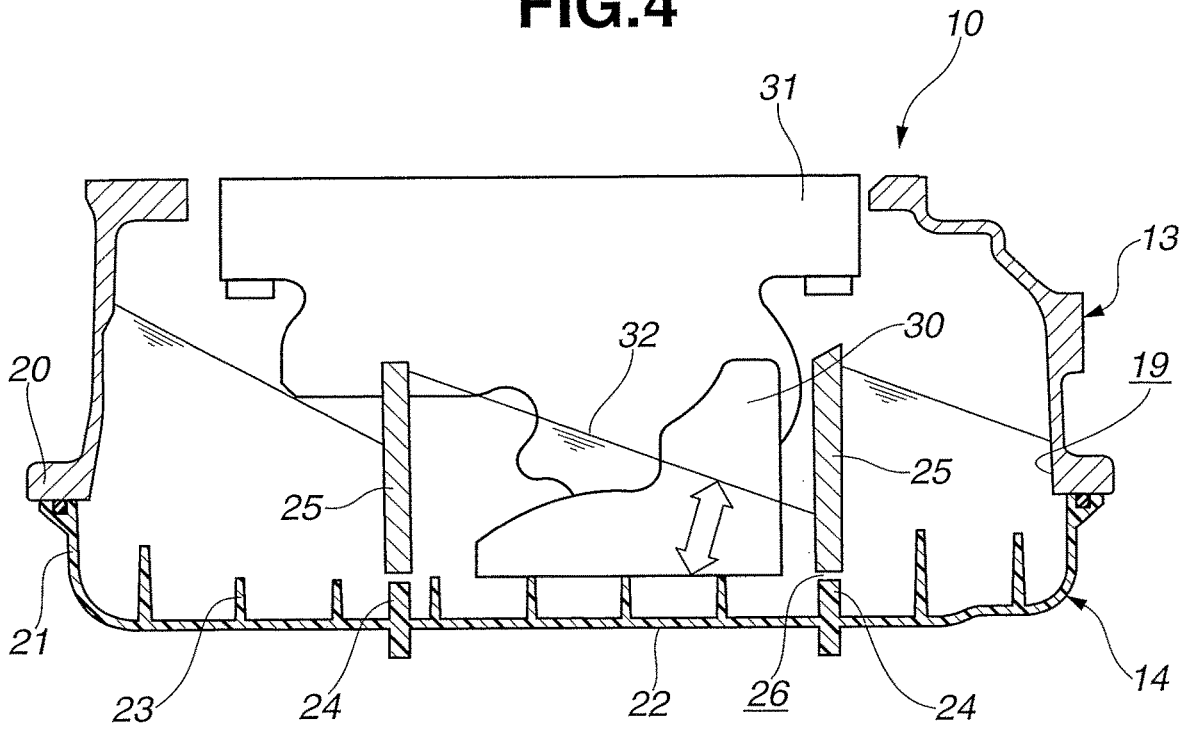
FIG. 4 A sectional view of the first embodiment of the oil pan, similar to FIG. 3.

As shown in FIG. 4, reinforcing ribs 23 are formed at suitable intervals in a vehicle width direction, and two deformation-preventing ribs 24 are disposed with a suitable interval in the vehicle width direction. Additionally, deformation-preventing ribs 24 are formed larger in thickness than reinforcing ribs 23 and slightly smaller than reinforcing ribs 23 in height so that the top surfaces of deformation-preventing ribs 24 are favorably contactable with bottom surfaces of beams 25 which will be mentioned later as strength members.

Figure 1:
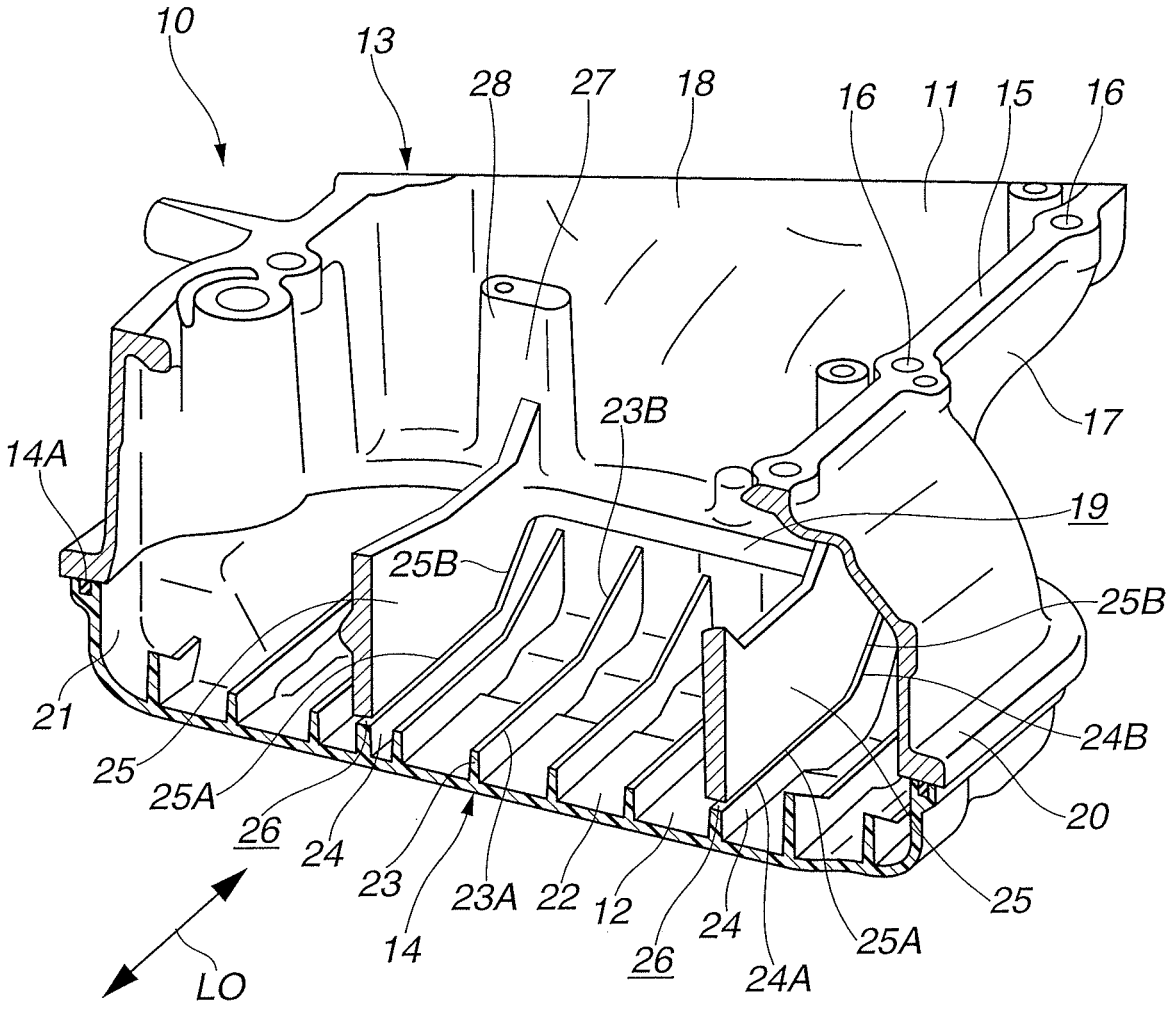
FIG. 1 A cutaway perspective view of a first embodiment of an oil pan for an internal combustion engine according to the present invention.
Figure 2:
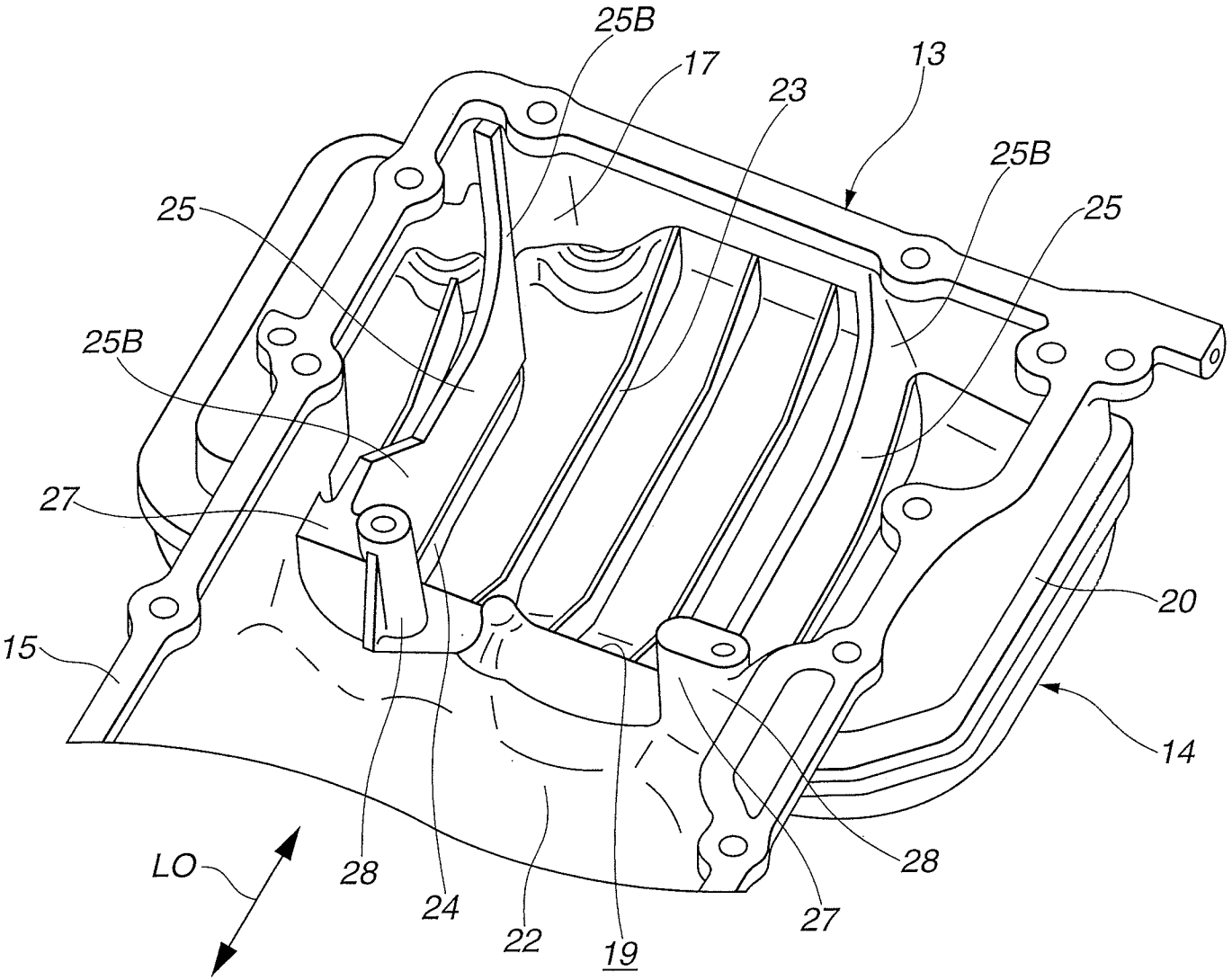
FIG. 2 A perspective view of the first embodiment of the oil pan, for showing an important part.

Metallic upper oil pan 13 is formed integral with two beams 25 as strength members extending in the front-rear direction of the vehicle or in the direction "LO", so as to correspond to two deformation-preventing ribs 24 that lower oil pan 14 has. As shown in FIG. 2, each of beams 25 is shaped like a thin plate protruding downward through lower side opening 19 toward the interior of lower oil pan 14. The bottom surface of beam 25 is shaped analogous with or shaped corresponding to the top surface of deformation-preventing rib 24 so as to ensure a certain extent of gap 26 therebetween over the whole length of the front-rear direction of the vehicle or of the direction "LO". In other words, each of beams 25 is shaped in such a manner that its bottom edge (or bottom surface) protrudes downwardly, and more specifically, provided to include flat region 25A the bottom edge of which is along a substantially horizontal direction and a pair of inclined regions 25B the bottom edges of which extend obliquely upward from both ends of flat region 25A.

Figure 3:
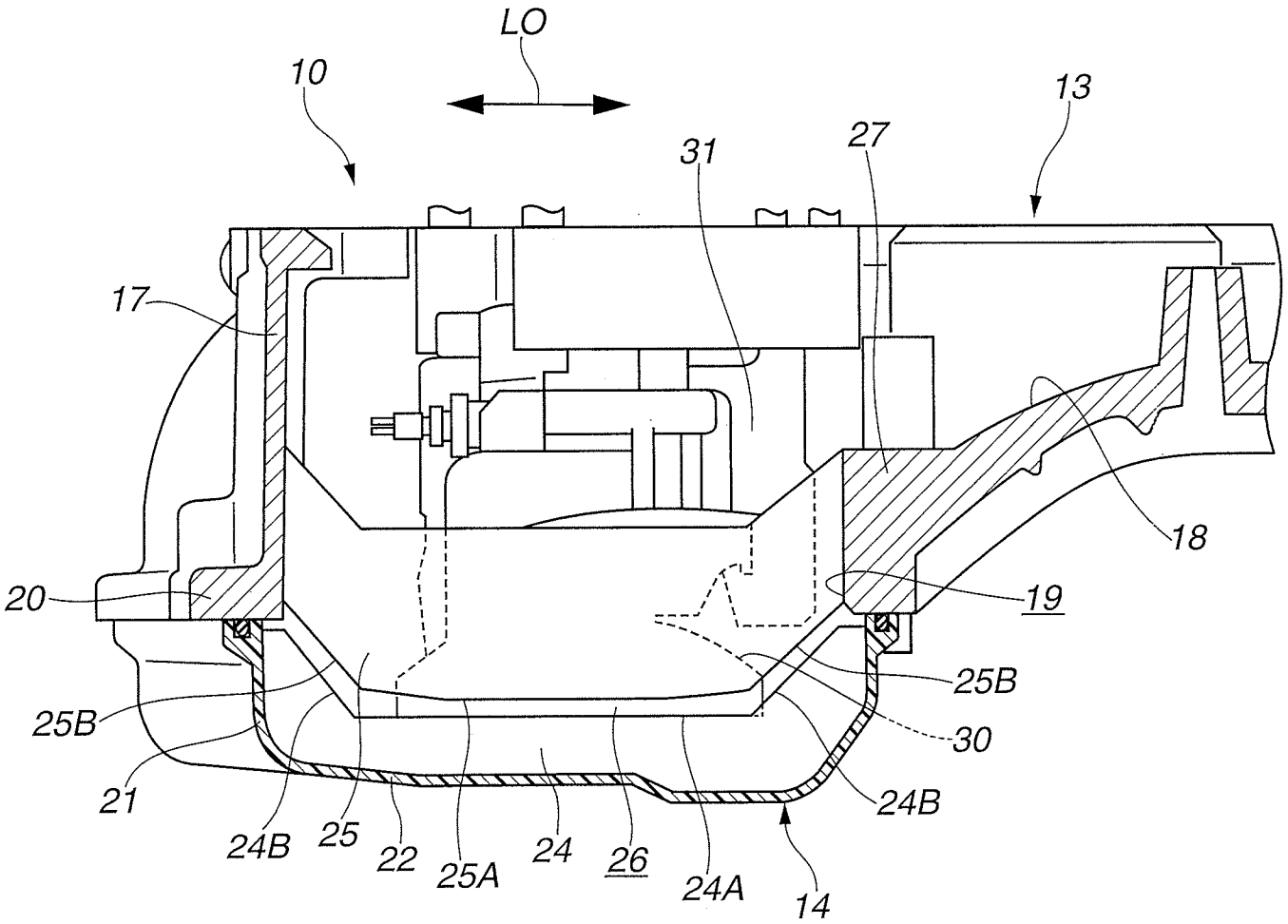
FIG. 3 A sectional view of the first embodiment of the oil pan.

As shown in FIGS. 2, 3 and the like, a front side end (in the front-rear direction of the vehicle) of both ends of beam 25 is integrally connected to peripheral wall portion 17 of upper oil pan 13 at the front side of upper oil pan 13. On the other hand, a rear side end (in the front-rear direction of the vehicle) of both ends of beam 25 is integrally connected to beam-supporting auxiliary wall portion 27 formed protruding from bottom wall portion 18 of upper oil pan 13 at the peripheral edge portion defining lower side opening 19, the auxiliary wall portion 27 being formed integral with bolt boss portion 28. In other words, auxiliary wall portion 27 is formed in a manner as to increase the thickness of bolt boss portion 28. Thus upper oil pan 13 is arranged to have auxiliary wall portion 27 in the vicinity of lower side opening 19 not enclosed with peripheral wall portion 17 under the favor of the presence of bolt boss portion 28, and a rear side one of both ends of inclined region 25B is integrally connected to auxiliary wall portion 27, thereby establishing a structure that can ensure an enough supporting rigidity of beam 25.

Incidentally, beams 25 are shaped such that their top edges are cut away downwardly, the op edges being located to have the substantially same height as bottom wall portion of shallow bottom part 11 has.

As shown in FIGS. 3 and 4, in the interior of oil pan 10, there is disposed an oil strainer 30 for sucking up an engine oil having been stored in the interior of oil pan 10 to deliver it to an oil pump side. The oil strainer 30, which constitutes a part of pump housing 31 fixed to the cylinder block, has a cone-like shape thinned with height, and disposed in such a manner that an oil inlet formed on the bottom surface of the cone shape is located in the vicinity of bottom wall section of lower oil pan 14. The oil strainer 30 is disposed in a space defined by two beams 25 and two deformation-preventing ribs 24.

As illustrated in FIG. 7, when lower oil pan 14 located at the bottommost of a vehicle interferes with curbstone 2, road surfaces and the like, lower oil pan 14 receives external force that can deform lower oil pan 14 in the front-rear direction of the vehicle (or in the direction "LO"). The present embodiment is arranged such that, at the time of lower oil pan 14 getting deformed, deformation-preventing ribs 24 of lower oil pan 14 are brought into contact with beams 25 provided to upper oil pan 13 to serve as strength members. With this arrangement, lower oil pan 14 is prevented from a further deformation in the front-rear direction of the vehicle (or in the direction "LO"). As a result, it becomes possible to effectively suppress an excessive deformation of lower oil pan 14 while forming lower oil pan 14 from a lightweight inexpensive synthetic resin material.

Since the present embodiment is so constructed that the load of lower oil pan 14 formed of synthetic resin is supported by beams 25 (or strength members) of metallic upper oil pan 13 having high rigidity and strength, it is possible to suppress the deformation of the lower oil pan certainly.

Furthermore, deformation-preventing ribs 24 of the present embodiment are shaped almost the same as that of reinforcing ribs 23 for ensuring the rigidity of lower oil pan 14 and therefore able to also function as reinforcing ribs 23. Hence modifications in shape and layout can be saved, so that production thereof can conveniently be performed.

In a normal state where external force that can deform lower oil pan 14 in the front-rear direction of the vehicle (or in the direction "LO") is not applied, there is ensured gap 26 between beam 25 of upper oil pan 13 and deformation-preventing rib 24 of lower oil pan 14, the gap 26 being for allowing an oil flow. Even though beam 25 and deformation-preventing rib 24 are closely disposed, engine oil can certainly excellently flow through the gap 26 in vehicle width direction. Additionally, since beam 25 and deformation-preventing rib 24 are disposed apart from each other through gap 26, abnormal sounds and vibrations due to contact between them never be generated unless external force due to the interference thereof with curbstones 2, road surfaces or the like is caused. Namely, the gap 26 is defined to have a size not inhibiting the circulation of engine oil in the normal circumstance while restraining the deformation of the synthetic resin-made lower oil pan 14 to an acceptable extent at the time of interfering with curbstones 2 or the like.

Particularly in the present embodiment, beam 25 of upper oil pan 13 has a shape protruding downwardly while deformation-preventing rib 24 has a shape cut away downwardly. Accordingly, beam 25 and deformation-preventing rib 24 are arranged to define gap 26 at a relatively low position, with which engine oil can smoothly flow through the gap 26 in the vehicle width direction even when the amount of engine oil gets little and when the oil level is inclined (at the time of cornering, for example).

Figure 5:
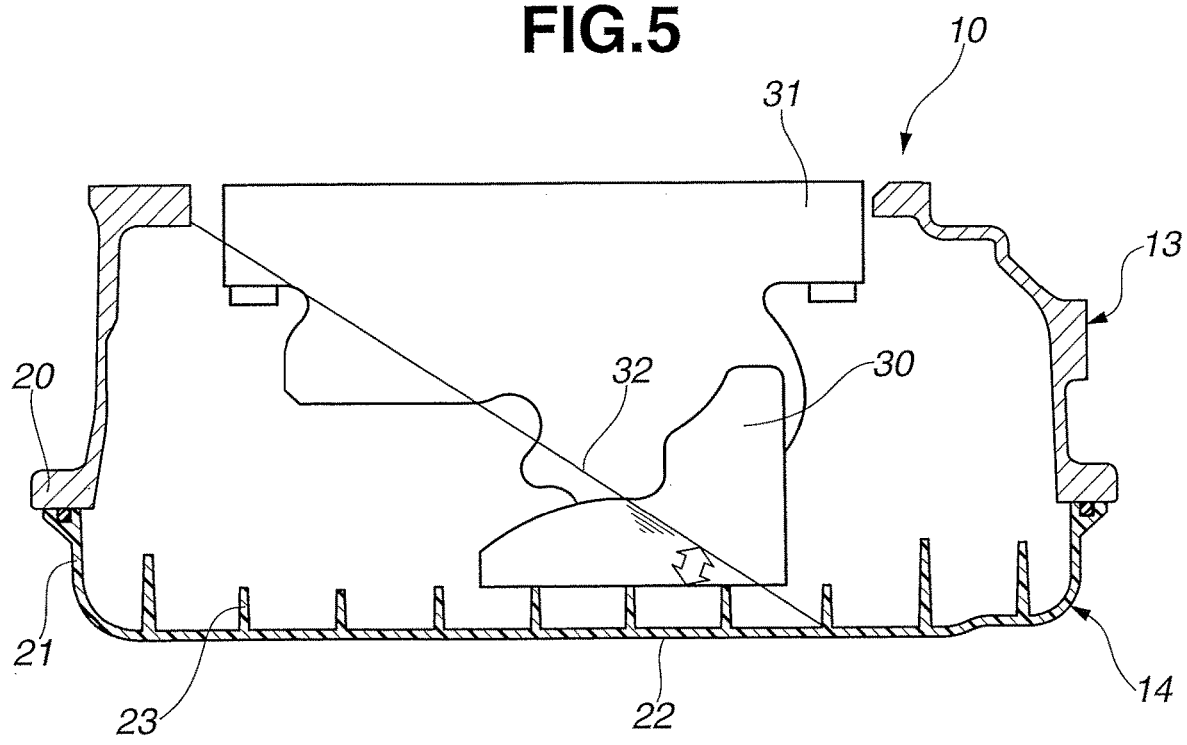
FIG. 5 A sectional view of an oil pan as a comparative example.

Furthermore, in the present embodiment, mutually opposite two pairs of beam 25 and deformation-preventing rib 24 are respectively disposed at two locations as shown in FIG. 4, and oil strainer 30 is located inside a space of oil pan 10 defined between the two pairs of beam 25 and deformation-preventing rib 24. FIG. 5 illustrates a comparative example where oil strainer 30 is not disposed inside the space defined between the two pairs of beam 25 and deformation-preventing rib 24. In the comparative example, there is a fear that the oil inlet formed on the bottom side of oil strainer 30 gets exposed to impair an oil-intake performance, for example when oil level 32 is inclined by inclination, cornering, acceleration or deceleration of the vehicle.

In contrast, the present embodiment is adapted such that oil level 32 is inclined inside the narrow space defined between the two pairs of beam 25 and deformation-preventing rib 24 as shown in FIG. 4, so as not to bring about the fear of the comparative example where the oil inlet formed on the bottom side of oil strainer 30 may get exposed to impair the oil-intake performance, even when oil level 32 is largely inclined. Moreover, oil pan 10 is provided with a bulkhead structure divided by the two pairs of beam 25 and deformation-preventing rib 24 in the vehicle width direction, so that the supporting rigidity is further improved.

Additionally, in the present embodiment, opposite surfaces of beam 25 and deformation-preventing rib 24 opposite to each other through gap 26, that is, the bottom surface of beam 25 and the top surface of deformation-preventing rib 24 have a pair of inclined regions 25B and a pair of inclined regions 24B, respectively, the inclined regions being respectively inclined with respect to the flat regions. When lower oil pan 14 interferes with curbstones 2 or the like, such an external force as to put lower oil pan 14 upwardly and rearwardly occurs; however, in the present embodiment where a pair of inclined regions 25B and a pair of inclined regions 24B are provided at the mutually contactable opposite surfaces, it is possible to effectively suppress the displacement of lower oil pan 14 even against the above-mentioned oblique external force.

In the following embodiments, structural components common with the above-mentioned embodiment are given the same reference numerals as in the above-mentioned embodiment in order to suitably prevent a repetition of explanation, and therefore matters different from the above-mentioned embodiment are mainly discussed.

Figure 8:
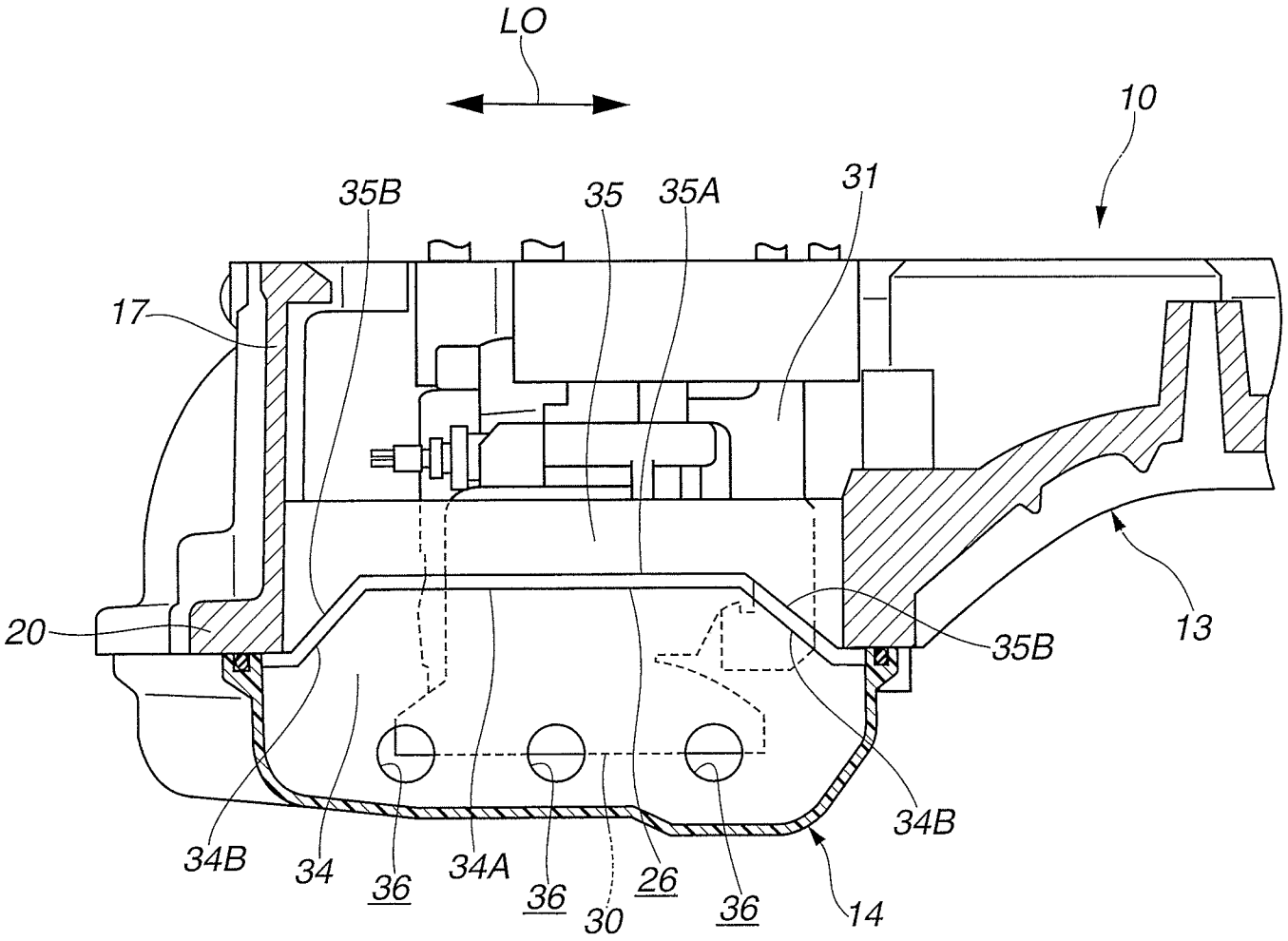
FIG. 8 A sectional view of a second embodiment of an oil pan for an internal combustion engine according to the present invention.

FIG. 8 illustrates a second embodiment of the present invention. In the second embodiment, deformation-preventing rib 34 of lower oil pan 14 is provided to have an upwardly protruding shape while beam 35 of upper oil pan 13 has a shape downwardly cut away so as to correspond to the upwardly protruding shape of the deformation-preventing rib 34, in a contrast manner to the first embodiment. More specifically, in the top edge of deformation-preventing rib 34, its flat region 34A is located at an uppermost position while inclined regions 34B serving as both ends of deformation-preventing rib 34 are inclined to gradually decline outwardly from flat region 34A. Likewise, in the bottom edge of beam 35, its flat region 35A is located at an uppermost position while inclined regions 35B serving as both ends of beam 35 are inclined to gradually decline outwardly from flat region 35A.

With the arrangement of the second embodiment where the lighter one between metallic beam 35 and synthetic resin deformation-preventing rib 34 (i.e., synthetic resin deformation-preventing rib 34) has an upwardly protruding shape while the relatively heavier one (i.e., metallic beam 35) has an upwardly cut away shape, it becomes possible to restrain the size of beam 35 to attain weight reduction.

However, since gap 26 defined between beam 35 and deformation-preventing rib 24 is located at a relatively high position as compared with the first embodiment, there is a fear that the flow of engine oil in the vehicle width direction is inhibited by flat region 34A of deformation-preventing rib 34 extending at the relatively high position. In view of the above, the second embodiment is adapted such that deformation-preventing rib 34 is formed with a plurality of through holes 36 for allowing an oil flow (in the present embodiment, the number of through holes is three). Through these through holes 36, engine oil can smoothly flow in the vehicle width direction.

Figure 9:
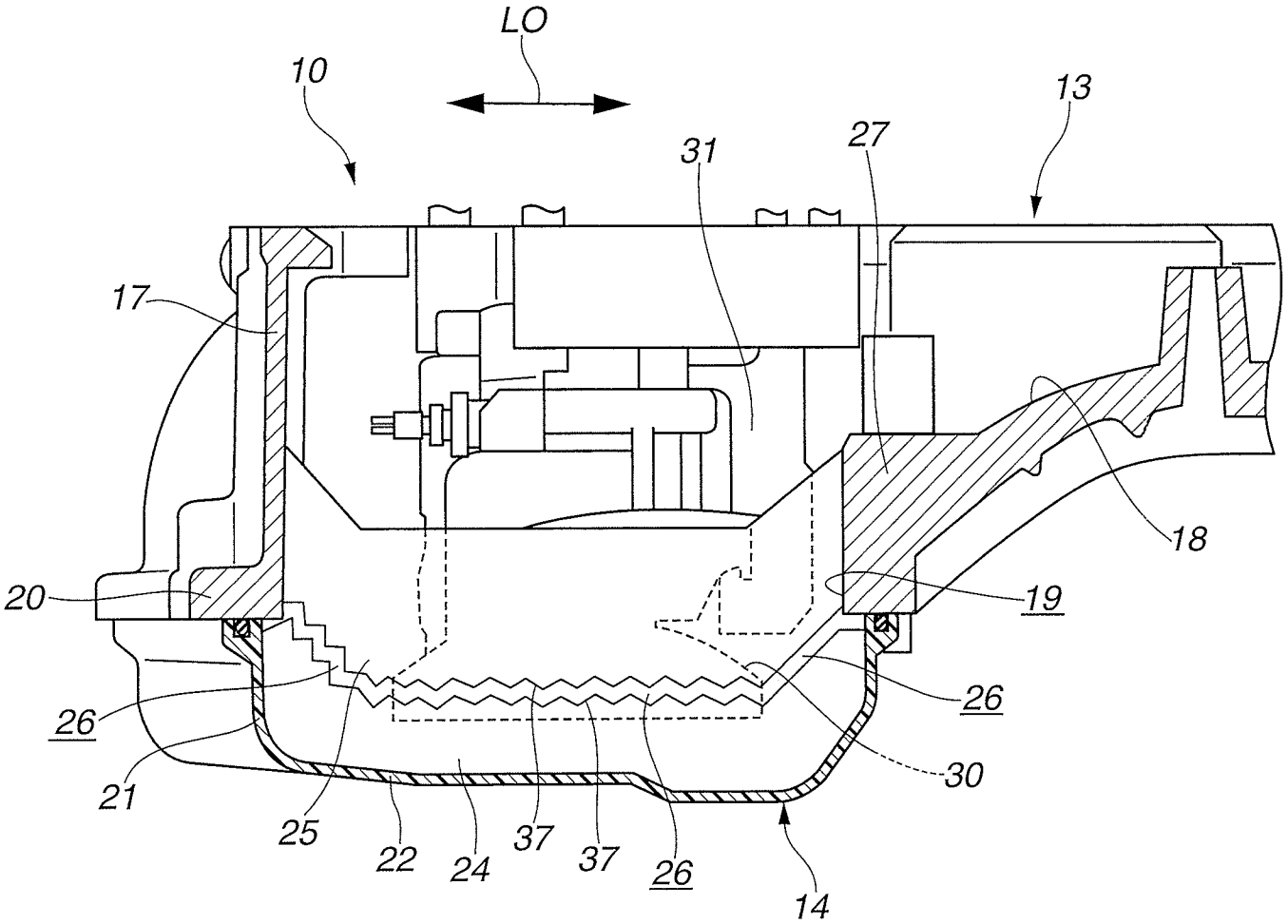
FIG. 9 A sectional view of a third embodiment of an oil pan for an internal combustion engine according to the present invention.

FIG. 9 illustrates a third embodiment of the present invention. In the third embodiment, beam 25 and deformation-preventing rib 24 opposite to each other through gap 26 are formed having uneven regions 37 at their opposite surfaces (or contacting surfaces), the uneven regions 37 being for preventing both beam 25 and deformation-preventing rib 24 from sliding along the front-rear direction of the vehicle (or along the direction "LO") when these members are brought into contact with each other. In the present embodiment, beam 25 and deformation-preventing rib 24 are respectively formed having uneven regions 37 (the staggered shapes of which are analogous to each other) at their opposite surfaces. Incidentally, the shape of the uneven regions 37 is not limited to the above one, and required only to be a somewhat unlevel one having a plurality of inclined or curved surfaces engageable with each other.

When lower oil pan 14 interferes with curbstones 2 or the like, such an external force as to put lower oil pan 14 upwardly and rearwardly occurs; however, in the case where beam 25 and deformation-preventing rib 24 are respectively formed having uneven regions 37 at their opposite surfaces as in the present embodiment, it is possible to more certainly suppress the displacement of lower oil pan 14 because uneven regions 37 can be engaged with each other.

Figure 10:
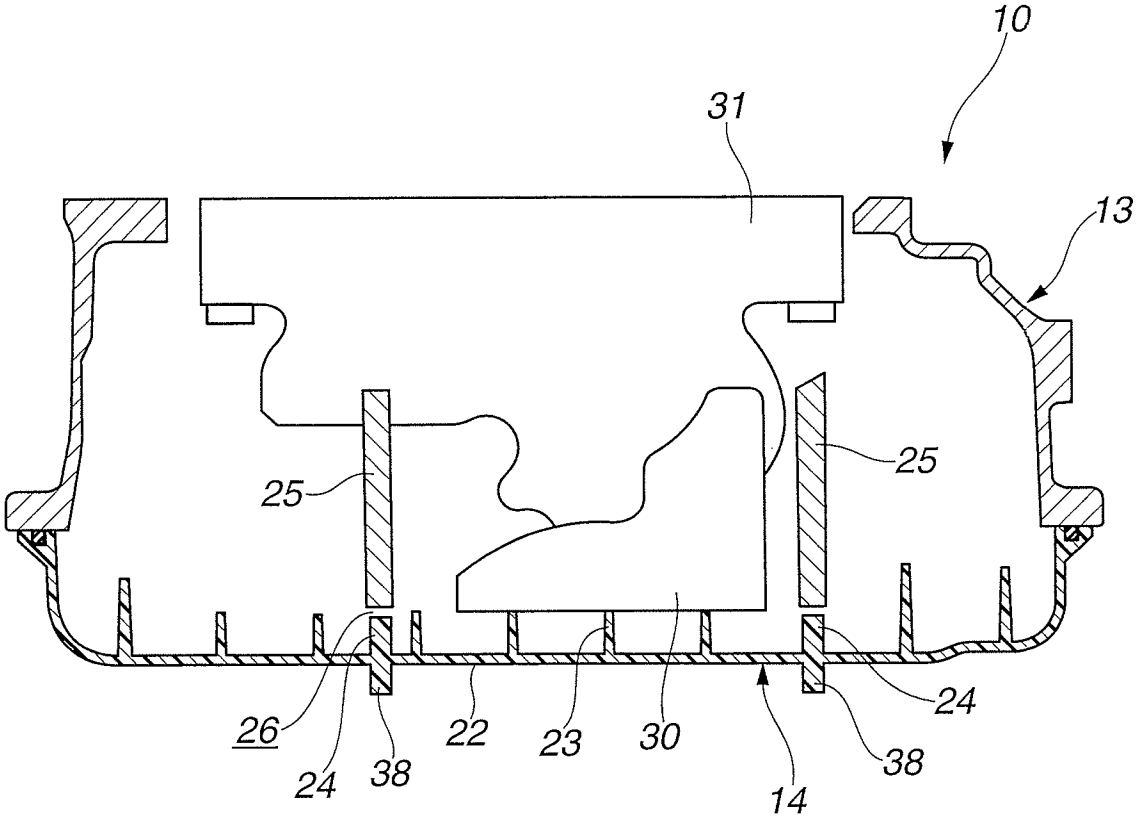
FIG. 10 A sectional view of a fourth embodiment of an oil pan for an internal combustion engine according to the present invention.

FIG. 10 illustrates a fourth embodiment of the present invention. In the fourth embodiment, at positions corresponding to deformation-preventing ribs 24 upwardly projectingly formed inside lower oil pan 14, there are provided outside ribs 38 formed outwardly (or downwardly) protruding from lower oil pan 14. Outside ribs 38 is shaped like a thin plate extending along the front-rear direction of the vehicle (or along the direction "LO"), similar to deformation-preventing ribs 24. In other words, a pair of deformation-preventing rib 24 and outside rib 38 is shaped like a thin plate in such a manner as to penetrate bottom wall section 22 of lower oil pan 14. The lower ends of outside ribs 38 are located at the lowermost position of oil pan 10.

With the arrangement of the fourth embodiment, when lower oil pan 14 interferes with curbstones 2 or the like, outside ribs 38 located at the lower most position are to be brought into interference with the curbstones 2 or the like in advance. External force received from the curbstones 2 or the like is infallibly transmitted through outside ribs 38 to the inner deformation-preventing ribs 24 with efficiency, with which the deformation of lower oil pan 14 can more certainly be suppressed.

Figure 11:
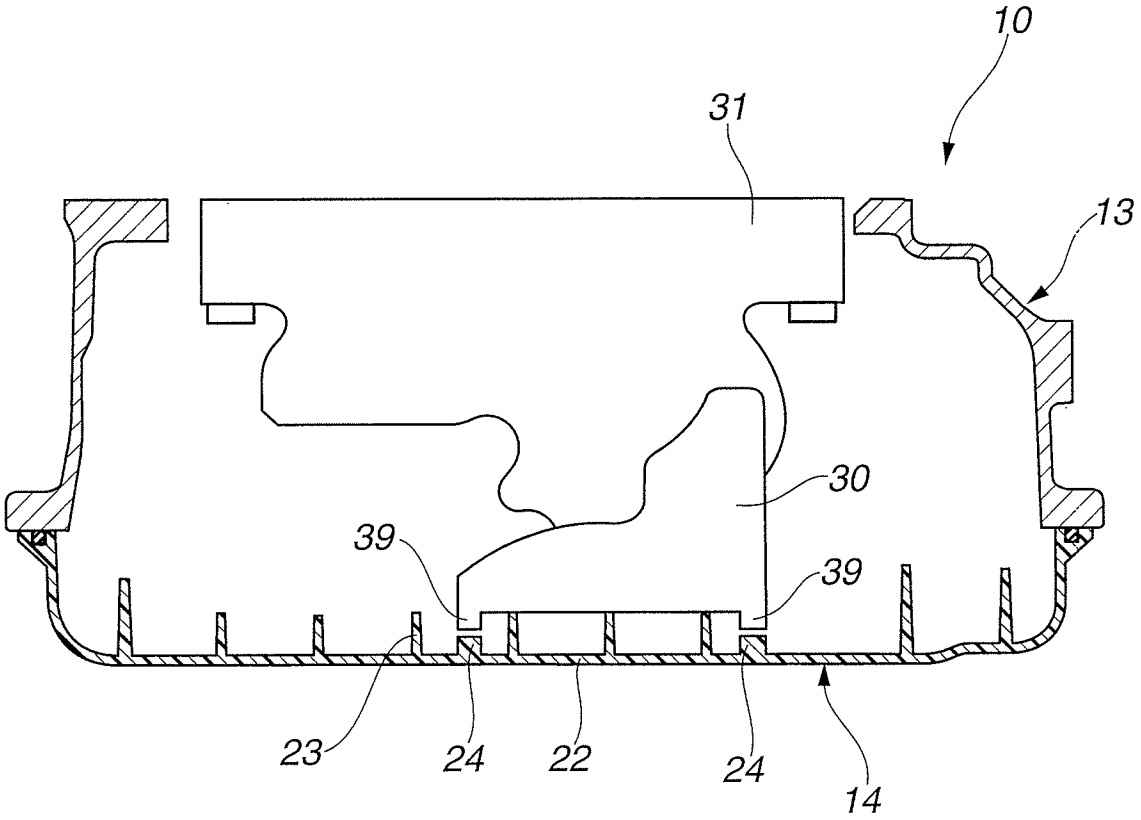
FIG. 11 A sectional view of a fifth embodiment of an oil pan for an internal combustion engine according to the present invention.
Figure 12:
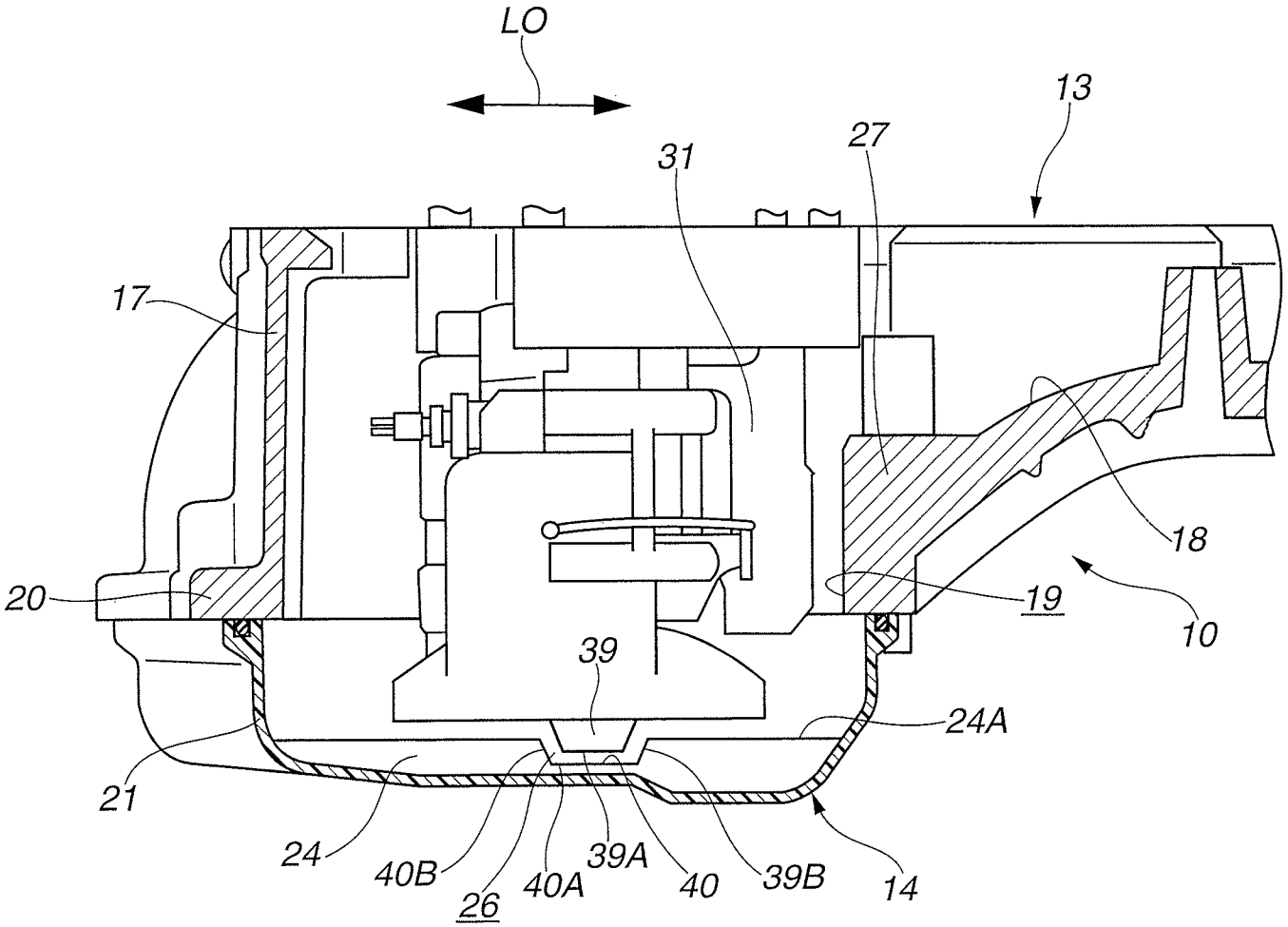
FIG. 12 A sectional view of the fifth embodiment of the oil pan for an internal combustion engine, similar to FIG. 12.

FIGS. 11 and 12 illustrate a fifth embodiment of the present invention. In the arrangement of the fifth embodiment, the strength member is constituted of pump housing 31 fixed to a cylinder block serving as an engine body, in place of the beams formed integral with upper oil pan 13 as in the first to forth embodiments. More specifically, oil strainer 30 behaving as a part of pump housing 31 is provided with projections 39 (that downwardly projects from the bottom surface of oil strainer 30 toward bottom wall section 22 of lower oil pan 14) as a strength member. As shown in FIG. 12, each of projections 39 has a downwardly protruding shape having at its bottom edge flat region 39A and a pair of inclined regions 39B, similar to beam 25 of the first embodiment. On the other hand, each of deformation-preventing ribs 24 provided to lower oil pan 14 has at its top edge a downwardly cut away recessed section 40 for accepting the above-mentioned projection 39. More specifically, each of deformation-preventing ribs 24 includes flat region 40A and a pair of inclined regions 40B at the recessed section 40. Between the projection 39 and the recessed portion 40, a certain extent of gap 26 is ensured.

With such an arrangement, projections 39 and recessed portions 40 or deformation-preventing ribs 24 of lower oil pan 14 are brought into contact with each other when external force that can deform lower oil pan 14 in the front-rear direction of the vehicle (or in the direction "LO") is applied. It is therefore possible to suppress a further deformation of lower oil pan 14 as well as the above-mentioned embodiments. In addition, if pump housing 31 is also used as the strength member as in the fifth embodiment, it may become possible to more simplify the structural arrangement.

Though the present invention has been explained on the basis of the concrete embodiments, the present invention is not limited to these embodiments. In the above embodiments the present invention is applied to an internal combustion engine of a longitudinally installed type; however, it is also possible to apply the present invention to an internal combustion engine of a transversely installed type where the direction of a crank shaft is in parallel with the vehicle width direction, for example. In this case also, beams and deformation-preventing ribs are formed along the front-rear direction of the vehicle as in the case of the above-mentioned embodiments.

Furthermore, it is also possible to dispose a pair of a beam and a deformation-preventing rib at one position or three or more positions, though the pair in the first embodiment and the like is disposed at two positions.

The invention claimed is:

1. An oil pan for an internal combustion engine of a vehicle and for storing an engine oil thereof, comprising:

an upper oil pan fixed to an engine body, the upper oil pan being formed of a metallic material;

a lower oil pan formed of a synthetic resin material, the lower oil pan having a bottom part and a peripheral part surrounding the bottom part, the peripheral part being sealingly fixed on a lower side of the upper oil pan;

first and second strength members that are beams fixed to the upper oil pan, the beams being formed integral with the upper oil pan, extending in a front-rear direction of the vehicle, and being disposed to have an interval therebetween in a width direction of the vehicle; and first and second ribs that extend in the front-rear direction of the vehicle, the first and second ribs being disposed to have an interval therebetween in the width direction of the vehicle, the first and second ribs being provided in an interior of the lower oil pan and beneath the beams to have a gap between opposite surfaces of the ribs and the beams so that the ribs are brought into contact with the beams to close the gap when external force which deforms the bottom part of the lower oil pan in the front-rear direction of the vehicle acts on the bottom part of the lower oil pan, thereby preventing the bottom part of the lower oil pan from further deforming in the front-rear direction of the vehicle, wherein each beam is shaped such that its bottom edge protrudes downwardly while each rib is shaped such that its top edge is so downwardly cut away as to accept the protruding shape of the respective beam.

2. An oil pan for an internal combustion engine, as claimed in claim 1, wherein an oil strainer is disposed inside a space defined between the beams and between the first and second ribs.

3. An oil pan for an internal combustion engine, as claimed in claim 1, wherein an inclined region formed inclining with respect to a horizontal plane is provided respectively on the opposite surfaces of the beams and the ribs.

4. An oil pan for an internal combustion engine, as claimed in claim 1, wherein, in the state of not receiving the external force which deforms the bottom part of the lower oil pan in the front-rear direction of the vehicle, the gap between the opposite surfaces of the beams and the ribs is configured to allow a flow of the engine oil therethrough.

5. An oil pan for an internal combustion engine, as claimed in claim 1, wherein each beam and each respective rib are formed having uneven regions at their opposite surfaces, for preventing both the beam and the rib from sliding along the front-rear direction of the vehicle when the rib is brought into contact with the beam.

6. An oil pan for an internal combustion engine, as claimed in claim 1, wherein the lower oil pan is provided with an outside projection extending in the front-rear direction of the vehicle, at a position beneath the ribs.

7. An oil pan for an internal combustion engine, as claimed in claim 1, wherein the beams are substantially parallel with respect to one another, and wherein the first and second ribs are substantially parallel with respect to one another and with respect to the beams.

* * * * *